US006447104B1

(12) United States Patent
Keil et al.

(10) Patent No.: US 6,447,104 B1
(45) Date of Patent: Sep. 10, 2002

(54) FIRING CHAMBER GEOMETRY FOR INKJET PRINTHEAD

(75) Inventors: Ronald W. Keil; Donald W Schulte, both of Carvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/804,905

(22) Filed: Mar. 13, 2001

(51) Int. Cl.[7] ..... B41J 2/05; B41J 2/17
(52) U.S. Cl. ..... 347/65; 347/94
(58) Field of Search ..... 347/365, 63, 94, 347/56, 20

(56) References Cited

U.S. PATENT DOCUMENTS 4,719,477 A 1/1988 Hess ..... 347/59
4,794,410 A 12/1988 Taub et al. ..... 347/65
5,519,423 A 5/1996 Moritz, III et al. ..... 347/65
5,529,423 A * 6/1996 Moritz, III et al. ..... 347/65
5,608,436 A * 3/1997 Baughman et al. ..... 347/65
6,042,222 A 3/2000 Moritz, III et al. ..... 347/65

* cited by examiner

*Primary Examiner*—John Barlow
*Assistant Examiner*—Juanita Stephens

(57) ABSTRACT

A firing chamber configuration for the drop ejectors of inkjet printheads extends the life of the heat transducer by ensuring that bubble collapse (and attendant cavitation) occurs at a location well spaced from the heat transducer. The sidewalls of the firing chamber are shaped relative to the firing chamber entry in a manner such that a strong jet of inflow ink is provided for moving the collapsing vapor bubble from the center of the chamber and against a curved back wall of the firing chamber. In one preferred embodiment, the refill ink impinges on the back wall, divides, and is redirected away from the back wall toward pockets defined in chamber. The pockets are remote from the heat transducer. As a result, the refill ink urges the collapsing (bifurcated) bubble into the pockets where final collapse occurs away from the heat transducer.

22 Claims, 2 Drawing Sheets

FIRING CHAMBER GEOMETRY FOR INKJET PRINTHEAD

TECHNICAL FIELD

This invention relates to the construction of ink drop ejector components of printheads used in inkjet printing.

BACKGROUND OF THE INVENTION

An inkjet printer typically includes one or more cartridges that contain ink. In some designs, the cartridge has discrete reservoirs of more than one color of ink. Each reservoir is connected via a conduit to a printhead that is mounted to the body of the cartridge. The reservoir may be carried by the cartridge or mounted in the printer and connected by a flexible conduit to the cartridge.

The printhead is controlled for ejecting minute drops of ink from the printhead to a printing medium, such as paper, that is advanced through the printer. The printhead is usually scanned across the width of the paper. The paper is advanced, between printhead scans, in a direction parallel to the length of the paper. The ejection of the drops is controlled so that the drops form recognizable images on the paper.

The ink drops are expelled through nozzles that are formed in a plate that covers most of the printhead. The nozzle plate is typically bonded atop an ink barrier layer of the printhead. That barrier layer is shaped to define ink chambers. Each chamber is in fluidic communication with and is adjacent to one or more nozzles through which ink drops are expelled from the chamber. Alternatively, the barrier layer and nozzle plate can be configured as a single member, such as a layer of polymeric material that has formed in it both the ink chambers and associated nozzles.

Ink drops are expelled from each ink chamber by a heat transducer, which typically comprises a thin-film resistor. The resistor is carried on an insulated substrate, such as a conventional silicon die upon which has been deposited an insulation layer, such as silicon dioxide. The resistor is covered with suitable passivation and cavitation-protection layers.

The resistor has conductive traces attached to it so that the resistor can be selectively driven (heated) with pulses of electrical current. The heat from the resistor is sufficient to form a vapor bubble in each ink chamber. The rapid expansion of the bubble propels a drop through the nozzle adjacent the ink chamber.

The chamber is refilled, after each drop ejection, with ink that flows into the chamber through a channel that connects with the conduit of reservoir ink. The components of the printhead (such as the heat transducer and ink chamber) for ejecting drops of ink are oftentimes referred to as drop ejectors. The action of ejecting a drop of ink is sometimes referred to as "firing" the resistor or drop ejector. The ink chambers are hereafter referred to as firing chambers.

The vapor bubble that propels the drop through the nozzle rapidly collapses after each firing. This rapid collapse of the vapor bubble can, over time, damage the heat transducer as a result of cavitation. Cavitation is a vapor pocket over the heat transducer. When the ink bubble breaks, the ink forms pressure spikes that erode the resistor surface over time. As a result, the resistor may short out. To limit the effects of cavitation, firing chambers in the past have been designed with sidewalls that ensure the flow of refill ink into the chamber will be somewhat unbalanced. That is, the flow of refill ink is limited to one or two directions (as opposed to flowing uniformly over the resistor from all sides) so that the flow of refill ink moves the collapsing bubble off of the center of the heat transducer.

The type of firing chamber configurations of concern here can be generally characterized as "three-sided" firing chambers wherein the refill ink flows into the firing chamber through a single entry in the chamber. U.S. Pat. No. 4,794,410 describes such a three-sided configuration. The properties of the refill-ink flow in prior three-sided designs is such that the collapsing vapor bubble is swept from the center of the resistor and pushed against the back corners of the firing chamber as the bubble collapse completes. This configuration is useful for extending the life of the resistor by protecting the center of the heat transducer from cavitation effects. Damage to the resistor, however, can still occur since the portions of the firing chamber walls where final bubble collapse occurs is designed to be very close to the heat transducer.

SUMMARY OF THE INVENTION

The present invention is directed to a firing chamber configuration for the drop ejectors of inkjet printheads that extends the life of the heat transducer by ensuring that bubble collapse occurs at a location well spaced from the heat transducer. The sidewalls of the firing chamber are shaped relative to the firing chamber entry in a manner such that a strong jet of inflow ink is provided for moving the collapsing vapor bubble from the center of the chamber and against a curved back wall of the firing chamber.

Apparatus and methods for carrying out the invention are described in detail below. Other advantages and features of the present invention will become clear upon review of the following portions of this specification and the drawings.

DETAILED DESCRIPTION OF PREFERRED EMBODIMENTS

In summary, a preferred embodiment of the present invention is a firing chamber configuration for the drop ejectors of inkjet printheads that extends the life of the heat transducer by ensuring that bubble collapse occurs at a location well spaced from the heat transducer. The sidewalls of the firing chamber are shaped relative to the firing chamber entry in a manner such that a strong jet of inflow ink is provided for moving the collapsing vapor bubble from the center of the chamber and against a curved back wall of the firing chamber.

The curved back wall is very near the heat transducer. The refill ink impinges on the back wall, divides, and is redirected away from the back wall toward pockets defined in the front of the chamber. The pockets are remote from the heat transducer. As a result, the refill ink urges the collapsing (bifurcated) bubble into the pockets where final collapse occurs away from the heat transducer.

The pockets in the chamber are formed at the junctions of the chamber sidewalls and front parts of the chamber wall that extend from each side of the entry. Opposing sidewalls of the firing chamber divergently extend from the back wall along the entire length of the sidewalls so that the greatest distance between the sidewalls (hence, the maximum width of the chamber) is at the junction of each sidewall with its respective front wall part. Put another way, the pockets reside just inside and offset from the entry so that the inflow of refill ink bypasses the relatively quiescent pockets to impinge against the curved back wall, which redirects that flow along the sidewalls back toward the pockets by formation of an eddy current.

In short, the ink chamber configuration provides a relatively strong inflow of refill ink for moving the collapsing bubble off the resistor, as well as remote (from the heat transducer) and relatively quiescent (from a flow perspective) pockets for receiving the bubble during its final stage of collapse so as to prevent cumulative damage to the heat transducer that might otherwise occur if the final bubble collapse occurred immediately adjacent to the resistor.

Figure 1:
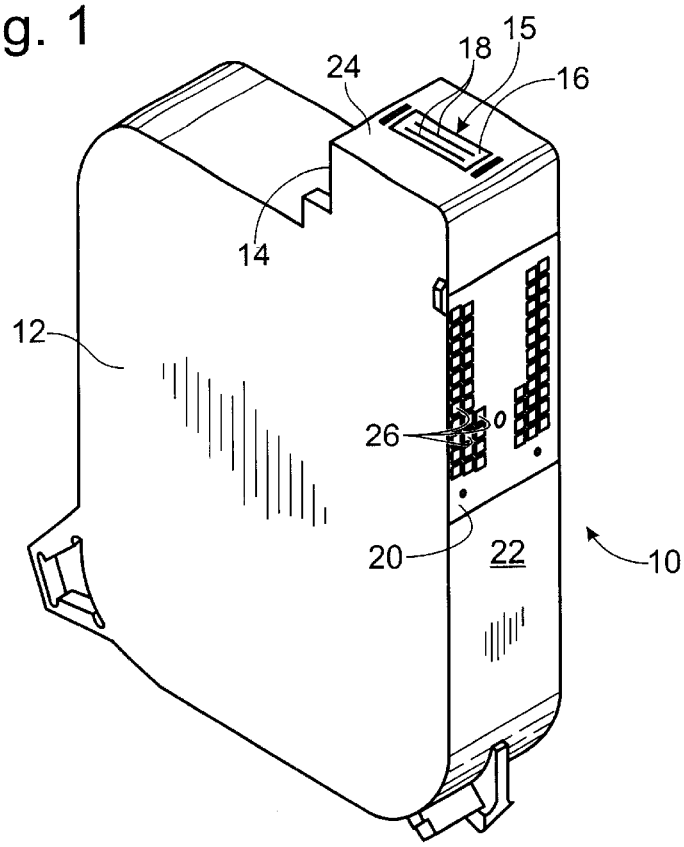
FIG. 1 is a perspective view of an inkjet printer cartridge having a printhead that incorporates the firing chamber configuration of the present invention.

FIG. 1 illustrates an inkjet printer cartridge 10 (shown inverted from its normal, installed position in a printer) that includes a plastic body 12 that defines a reservoir for ink. The cartridge body 12 is shaped to have a downwardly extending snout 14. A printhead 15 is attached to the underside of the snout 14. The exposed portion of the printhead is the exterior surface of a rectangular nozzle plate 16 that includes minute nozzles 18 (in this instance, two rows of nozzles) from which are ejected ink drops onto printing medium that is advanced through the printer. The printing medium advances very near to and generally substantially parallel to the nozzle plate 16.

A thin circuit 20 is attached to the body 12 of the cartridge 10, partly on one side 22 of the cartridge adjacent the snout 14. The circuit extends from the side 22 and bends substantially in a perpendicular direction to extend across most of the underside 24 of the snout 14. However, the circuit does not cover the nozzle plate 16. The circuit 20 may be a thin polyimide material that carries conductive traces. The traces connect at one end to contact pads (not shown) in the printhead 15 that are near the long edges of the nozzle plate 16. The other ends of the traces terminate in contact pads 26 on the circuit, which pads mate with corresponding pads on a carriage (not shown).

The circuit 20 carries control signals from a microprocessor-based printer controller to the individual components in the printhead 15 (primarily the heat transducers) that produce the ink drop ejection through the nozzles 18 of the nozzle plate 16.

Figure 2:
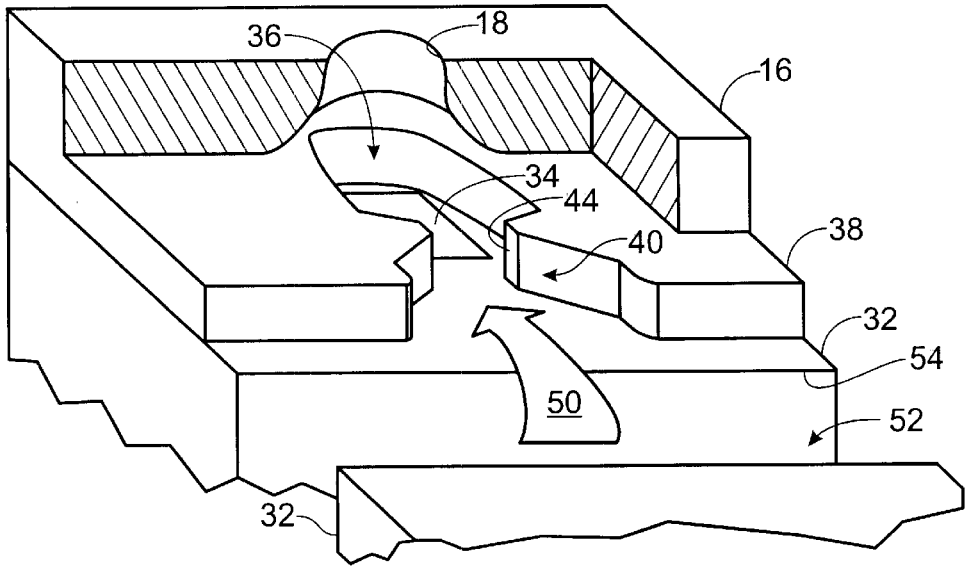
FIG. 2 is a cutaway perspective view of a portion of a printhead drop ejector for illustrating the primary components of the present invention.

The greatly enlarged cutaway view of FIG. 2 illustrates in perspective view a single firing chamber and associated nozzle of a printhead. In particular, the printhead comprises a substrate 32, such as a conventional silicon die upon which has been grown an insulation layer, such as silicon dioxide.

A thin-film resistor (or heat transducer) 34 is formed on the substrate and is covered with suitable passivation and cavitation-protection layers, as is known in the art and described, for example, in U.S. Pat. No. 4,719,477, hereby incorporated by reference. A patterned layer of electrically conductive material (not shown) separately conducts the above-mentioned current pulses to the resistor 34 for heating the resistor. A firing chamber 36 substantially surrounds the resistor 34. The resistor vaporizes the ink in the firing chamber 36.

In this embodiment, the shape of each individual firing chamber 36 is primarily defined below by the resistor and along sides by a barrier layer 38. The barrier layer 38 is made from photosensitive material that is laminated onto the printhead substrate 32 and then exposed, developed, and cured. The barrier layer also defines an ink inlet channel 40 to each chamber through an opening in one of the walls of the barrier layer. Each channel 40 is tapered to form a pinch point or entry 44 through which ink flows into the chamber 36 as discussed more below.

Ink drops are ejected through a nozzle 18 (one of which is shown cut away in FIG. 2) that is formed in the above mentioned nozzle plate 16 that covers most of the printhead 15. The nozzle plate 16 may be made from, for example, electrodeposited metal or a laser-ablated polyimide material, or any other suitable material. The nozzle plate 16 is bonded to the barrier layer 38 and aligned so that each firing chamber 36 is continuous with and in fluidic communication with one of the nozzles 18 from, which the ink drops are ejected. In one preferred embodiment, the nozzle 18 is directly above and centered over its associated firing chamber 36.

As the ink layer covering the resistor 34 is vaporized, the resultant expansion of that fluid forces the remaining ink out the chamber in the form of a drop that is ejected through the adjacent nozzle 18.

The pressure drop attributable to the departure of the fired ink drop and the attendant collapse of the vapor bubble that fired it draws refill ink through the channel 40 and into the chamber 36. In the presently preferred embodiment, refill ink (generally depicted as arrow 50) flows from the cartridge reservoir through an ink feed slot 52 formed in the substrate 32 of the printhead and across an edge 54 of the feed slot into the channel 40.

FIG. 2 depicts one exemplary firing chamber 36 that is next to the feed slot 52 that is formed in the center of the printhead substrate 32. The firing chambers are located on opposing sides of the center feed slot 52 such that the channels of all the firing chambers of the printhead open to the central ink-feed slot of the printhead.

In other embodiments, the refill ink flows over a side edge of the printhead rather than through the middle of printhead substrate 32. The channels of the chambers open to sides of the printhead rather than to the middle (not shown).

The refill ink 50 flows through the entry 44 of the channel on its way to refill the chamber 36. As noted above, the firing chamber configuration is designed to extend the life of the heat transducer 34 by ensuring that bubble collapse occurs at a location well spaced from the heat transducer. This is accomplished primarily by managing the flow characteristics of the refill ink. The particulars of the chamber configuration for doing this are explained next with reference to FIGS. 3–5.

Figure 3:
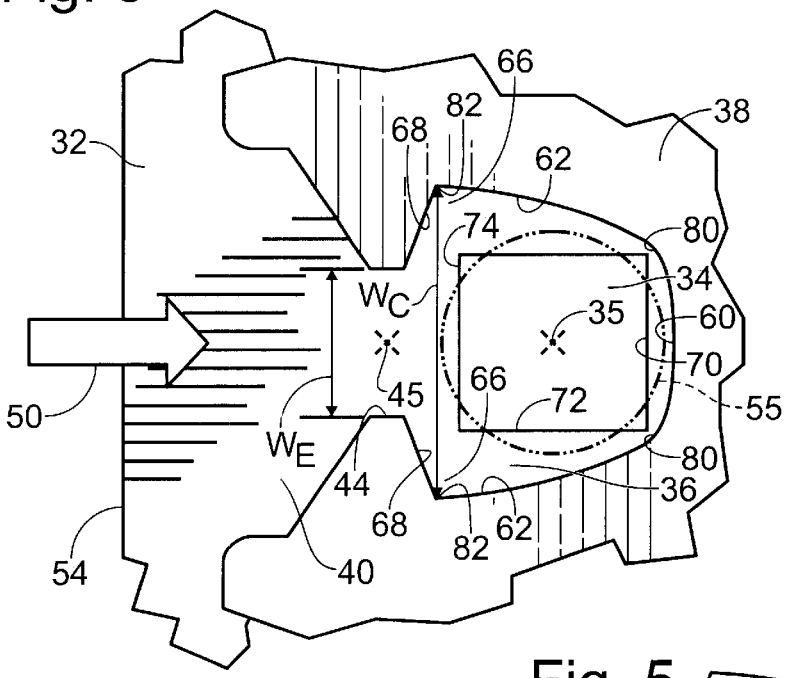
FIG. 3 is a plan view diagram of one preferred embodiment of the firing chamber of the present invention.

FIG. 3 depicts one preferred embodiment of the present invention. This figure is a top view of a single drop ejector of an inkjet printhead. In this view, the nozzle plate is removed to show the configuration of the underlying firing chamber 36 (which is defined by the walls of the barrier layer or member 38), the heat transducer 34, and the associated channel 40. In particular, the embodiment of FIG. 3 shows part of the printhead substrate 32, including the edge 54 across which refill ink 50 flows to each chamber following each firing of a droplet via the instantaneous expansion of a vapor bubble as explained above.

The inflow direction of refill ink is through the entry 44 toward a center 35 of the heat transducer 34. Thus, for orientation purposes, a line extending between a center 45 of the entry 44 and the center 35 of the heat transducer can be considered as an inflow direction, which is aligned with the center of arrow 50 (direction of ink flow) in FIG. 3. Immediately after a drop of ink is fired, the vapor bubble 55 (dashed lines in FIG. 3) that caused the droplet ejection resides over the center 35 of the heat transducer 34 and begins to collapse substantially simultaneously with the inflow of the refill ink 50.

The firing chamber 36 has a back wall 60 and two opposing sidewalls 62 surrounding the resistor 34. The back wall 60 and opposing sidewalls 62 are formed by the barrier layer 38. The back wall 60 is opposite the chamber entry 44. The opposing sidewalls 62 of the firing chamber 36 are shaped relative to the firing chamber entry 44 so that a strong jet of refill ink is provided for moving the collapsing vapor bubble 55 from the center of the chamber 36 and against the curved back wall 60 of the firing chamber. More particularly, the back wall 60 is curved and is very near a back edge 70 of the generally square heat transducer 34. In a preferred embodiment, the back wall 60 of the chamber 36 is curved along a radius of about twice the width of the heat transducer 34 (which width may be, for example, about 12 $\mu$m), and spaced within about 3 $\mu$m of the rear edge 70.

Figure 4:
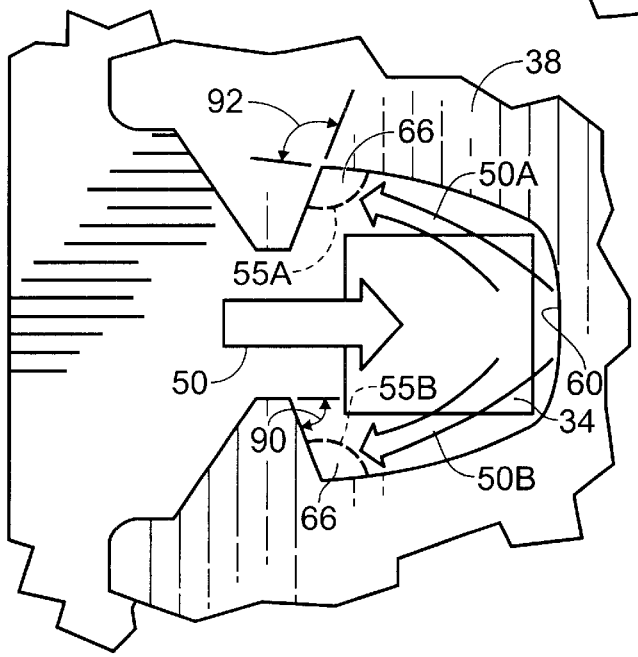
FIG. 4 is a view like FIG. 3 for illustrating refill-ink flow and bubble collapse that takes place in the firing chamber of the present invention.

As illustrated in FIG. 4, the inflow of refill ink 50, once across the center of the heat transducer, impinges on the curved back wall 60 and divides into what may be characterized as two flow components 50A and 50B. The collapsing vapor bubble is deflected off the back wall 60 and is sheared into two main components 55A, 55B. These bubble components are directed by the refill ink flow components 50A, 50B into two pockets 66 formed in the chamber 36 by the barrier walls as described next.

The pockets 66 are located on each side of the chamber adjacent the channel entry 44. The flow components 50A, 50B of the refill ink (that is the flow that is substantially redirected away from the back wall 60 of the chamber 36) do not interfere with the remaining inflow 50 of refill ink. In one embodiment the pockets form a zone of relative stagnation with respect to the flow 50. As can be seen in FIG. 3, the pockets 66 are located just inside of each of two parts 68 of the barrier member 38 that define a front wall of the chamber 36. These front wall parts 68 extend from each side of the channel entry 44 into the chamber (FIG. 3).

Thus, from a flow perspective, it will be appreciated that the pockets 66 of the firing chamber 36 provide a relatively quiescent portion of the re-filling chamber as compared to the refill ink inflow 50 moving through the entry 44 toward the heat transducer. Therefore, as the refill ink enters the chamber 36, it substantially bypasses the pockets 66 where the vapor bubbles are undergoing the final stages of collapse.

The pockets 66 are defined in part by the sidewalls 62 of the chamber 36. In particular, the barrier member 38 is shaped so that the chamber sidewalls diverge relative to each other as they extend from the respective junctions (back corners 80) with the back wall 60. In a preferred embodiment, the divergence is continuous so that at front corners 82 of the firing chamber (that is, the junction of one of the sidewalls 62 with the adjacent front wall part 68) represents a widest part $W_C$ of the chamber 36 as measured perpendicular to the refill ink inflow direction.

In a preferred embodiment, the maximum chamber width is more than 50% larger than the width of the heat transducer (again, measured perpendicular to inflow direction 50). Also, as shown in FIG. 3, this widest part of the chamber $W_C$ (hence, the location of the pockets) occurs between a front edge 74 of the heat transducer adjacent the entry 44 and the entry 44 of the chamber. As shown in FIG. 4, this location of the pockets 66 helps to ensure that the final stages of bubble collapse occur well away from the heat transducer. Put another way, the maximum firing chamber width $W_C$ is, preferably, more than 50% larger than a width $W_E$ of the entry 44, thereby to provide pockets 66 adequately large to accommodate bubble collapse without simultaneously interfering with the adjacent inflow 50 of refill ink.

In one embodiment, the front comers 82 and the back corners 80 are formed with small radii (and not sharp angles) so as to ensure smooth flow of the refill ink across those corners.

The front wall parts 68 of the chamber join the sidewalls 62 to define the front corners 82 and shape the pockets 66. In order to locate the pockets 66 most distant from the heat transducer and avoid interference with the inflow 50, an entry angle 90 (shown as arrow 90 in FIG. 4), made between the front wall parts 68 and a line parallel to the inflow direction 50, is selected to be relatively large. Preferably the entry angle 90 is more than 45 degrees from parallel to the inflow direction 50. In one embodiment, the entry angle 90 is between 45° and 90°.

The entry angle 90, when considered with the divergence of the sidewalls 62, results in a relatively small corner angle 92 located at the junction of each front wall part 68 and sidewall 62 (that is, the angle of the front corner 82). The corner angle is illustrated at 92 in FIG. 4 (outside of the corner, for clarity) and in the present embodiment is less than 120 degrees. In another embodiment, the angle 92 is greater than 90 degrees.

Figure 5:
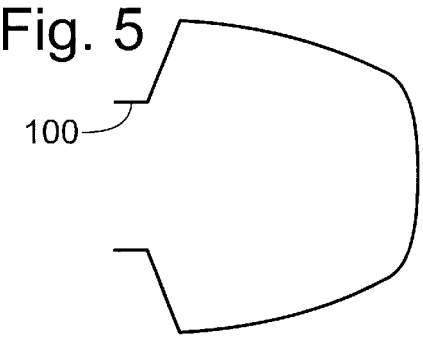
FIG. 5 is a line drawing representing the shape of walls of a firing chamber in accordance with the present invention.

FIG. 5 depicts a simple line drawing 100 that provides the outline of the barrier member walls that define the firing chamber shape of the present invention, the relative dimensions of which were just described.

One of ordinary skill will appreciate that although a particular firing chamber geometry has been described here in connection with a preferred embodiment, there are available a variety of ways for forming the pockets as described above. For example, the present invention may include one pocket that is located away from the heat transducer, such that the bubble collapse does not occur over the heat transducer. As long as the bubble collapse occurs in a pocket that is spaced from the heat transducer, the heat transducer will not be damaged due to cavitation. The pockets may be located anywhere along the sidewalls of the chamber. The back wall is shaped to direct the ink bubble towards the pocket(s). Also, for example, the ink chamber configuration need not be symmetrical about the inflow direction. That is, the sidewalls and pockets may be asymmetrically disposed about the centerline of the chamber. Another such asymmetrical version may feature only one pocket defined in part by a sidewall that diverges (more than the other sidewall) relative to the side edge of the heat transducer.

Thus, having here described preferred embodiments of the present invention, it is anticipated that individuals skilled in the art may make other modifications thereto within the scope of the invention. The spirit and scope of the invention is not limited to those embodiments, but extend to the various modifications and equivalents of the invention defined in the appended claims.

What is claimed is:

1. A drop ejector comprising:

a heat transducer; and a barrier member having walls defining a firing chamber and substantially surrounding the heat transducer, wherein the walls include opposing sidewalls, a front wall with an entry into the firing chamber, and a back wall opposite the front wall, wherein the opposing sidewalls divergently extend from the back wall towards the front wall and along the heat transducer.

2. The drop ejector of claim 1 wherein each sidewall joins the back wall to define a back corner, and wherein the front wall of the barrier member includes two front wall parts, each one of the front wall parts extending from the entry to a junction with one of the sidewalls to define a front corner, one of the front corners being spaced farther from the heat transducer than either back corner is spaced from the heat transducer.

3. The drop ejector of claim 2 wherein each one of the front corners is spaced farther from the heat transducer than either back corner is spaced from the heat transducer.

4. The drop ejector of claim 2 wherein the barrier walls that define at least one of the front corners form an angle of less than 120 degrees at that front corner.

5. The drop ejector of claim 1 wherein the entry has a center and the heat transducer has a center and wherein a line between those centers represents an inflow direction, and wherein the front wall parts of the barrier member are angled more than 45 degrees from parallel with the inflow direction.

6. The drop ejector of claim 1 wherein the entry has a center and the heat transducer has a center and wherein a line between those centers represents an inflow direction, and wherein a firing chamber width is measured along a line perpendicular to the inflow direction, and wherein the maximum firing chamber width occurs between the entry and the heat transducer.

7. The drop ejector of claim 6 wherein the maximum firing chamber width is more than 50% larger than the width of the heat transducer.

8. The drop ejector of claim 6 wherein the entry has a width that is measured in a direction that is parallel to the width of the chamber and wherein the maximum firing chamber width is more than 50% larger than the width of the entry.

9. The drop ejector of claim 1 wherein the back wall is curved to direct an ink bubble away from the heat transducer.

10. A drop ejector for an inkjet printhead comprising:

a heat transducer; and a barrier member, including a firing chamber defined by walls of the barrier member, the walls substantially surrounding the heat transducer, wherein the walls include a back wall, opposing sidewalls, and an entry through which ink may flow into the chamber, the entry being opposite the back wall so that ink is capable of flowing in an inflow direction through the entry into the chamber between the opposing sidewalls, the inflow direction corresponding to a line between a center of the entry and a center of the heat transduce, the back wall joining the sidewalls at rounded corners, and the barrier member walls including a pair of front wall parts extending from opposite sides of the entry into the chamber and angled to be more than 45 degrees from parallel with the inflow direction.

11. The drop ejector of claim 10 wherein the opposing sidewalls divergently extend with respect to each other from the back wall toward the front wall parts and join the front wall parts.

12. The drop ejector of claim 11 wherein the junctions of the sidewalls and the front wall parts define front corners that are portions of the firing chamber walls most distant from the heat transducer.

13. The drop ejector of claim 12 wherein the distance between the front corners as measured perpendicular to the inflow direction is more than 50% greater than the width of the heat transducer as measured perpendicular to the inflow direction.

14. The drop ejector of claim 12 wherein the entry has a width as measured perpendicular to the inflow direction and wherein the distance between the front corners as measured perpendicular to the inflow direction is more than 50% greater than the width of the entry.

15. A drop ejector for an inkjet printhead comprising:

a heat transducer having a back edge, a front edge, and two side edges; and a barrier member including a firing chamber defined by walls of the barrier member, the walls substantially surrounding the heat transducer, wherein the walls include a back wall, two sidewalls, and an entry through which ink is capable of flowing into the chamber to cover the heat transducer, the entry being substantially opposite the back wall so that ink is capable of flowing in an inflow direction through the entry into the chamber between the two sidewalls of the chamber, each sidewall being adjacent one of the two side edges of the heat transducer, wherein at least one sidewall extends from the back wall to diverge from the adjacent side edge of the heat transducer so that a distance between the at least one sidewall and the adjacent heat transducer side edge is at a maximum when a location of the at least one sidewall is most remote from the back wall.

16. The drop ejector of claim 15 wherein the back wall is curved.

17. The drop ejector of claim 16 wherein the location where the at least one sidewall is most remote from the heat transducer is spaced from the entry such that ink flowing through the entry substantially bypasses the location before impinging on the curved back wall and such that at least some of the ink is directed by the back wall toward the location.

18. The drop ejector of claim 15 wherein each one of the two sidewalls diverges from the adjacent side edge of the heat transducer so that the distance between the two side walls is greatest where the sidewalls are most remote from the back wall and wherein this greatest distance defines a maximum width of the chamber that occurs between the entry and the heat transducer, and wherein the entry has a width that is substantially less than the maximum chamber width.

19. The drop ejector of claim 18 wherein the back wall is curved so that the flow of ink through the entry into the chamber impinges upon the back wall and is redirected toward the locations on the sidewalls that are most remote from the back wall.

20. A drop ejector comprising:

a heat transducer; and a barrier member having walls defining a firing chamber and substantially surrounding the heat transducer, wherein the walls include opposing sidewalls, a front wall with an entry into the firing chamber, and a back wall opposite the front wall, wherein at least one pocket is formed along the opposing sidewalls, wherein the back wall is curved to direct a bubble away from the heat transducer and into the at least one pocket.

21. The drop ejector of claim 20 wherein the at least one pocket is formed at a junction of the front wall with at least one of the opposing sidewalls.

22. An inkjet printer cartridge comprising:

an inkjet printhead; and a drop ejector, wherein the drop ejector has a heat transducer; and a barrier member having walls defining a firing chamber and substantially surrounding the heat transducer, wherein the walls include opposing sidewalls, a front wall with an entry into the firing chamber, and a back wall opposite the front wall, wherein the opposing sidewalls divergently extend from the back wall towards the front wall and along the heat transducer.

* * * * *

UNITED STATES PATENT AND TRADEMARK OFFICE

CERTIFICATE OF CORRECTION

PATENT NO. : 6,447,104 B1
DATED : September 10, 2002
INVENTOR(S) : Keil et al.

It is certified that error appears in the above-identified patent and that said Letters Patent is hereby corrected as shown below:

Column 7,
Line 62, “transduce” should read -- transducer --.

Signed and Sealed this

Twenty-fifth Day of February, 2003

JAMES E. ROGAN
*Director of the United States Patent and Trademark Office*